US005104514A

United States Patent [19]

Quartarone

[11] Patent Number: 5,104,514

[45] Date of Patent: Apr. 14, 1992

[54] PROTECTIVE COATING SYSTEM FOR ALUMINUM

[75] Inventor: James M. Quartarone, Portsmouth, R.I.

[73] Assignee: The United States of America as represented by the Secretary of the Navy, Washington, D.C.

[21] Appl. No.: 700,831

[22] Filed: May 16, 1991

[51] Int. Cl.[5] ..... C25D 5/44

[52] U.S. Cl. ..... 205/203; 205/201; 205/206; 205/208; 205/224

[58] Field of Search ..... 204/29, 33, 38.3, 38.6, 204/38.7, 37.1, 37.6; 205/201, 203, 205, 206, 208, 224

[56] References Cited

U.S. PATENT DOCUMENTS

| | | | |
|---|---|---|---|
| 4,086,114 | 4/1978 | Karol | 156/153 |
| 4,568,573 | 2/1986 | Sunoda et al. | 427/350 |
| 4,589,972 | 5/1986 | Pompea et al. | 205/206 X |
| 4,624,752 | 11/1986 | Arrowsmith et al. | 205/210 X |

OTHER PUBLICATIONS

F. A. Lowenheim, *Electroplating*, McGraw-Hill Book Co., New York, 1978, pp. 452-475.

H. Silman et al., *Protective and Decorative Coatings for Metals*, Finishing Publications, Ltd., Teddington, Middlesex, England, 1978, p. 485.

*Primary Examiner*—John Niebling
*Assistant Examiner*—William T. Leader
*Attorney, Agent, or Firm*—Michael J. McGowan; Prithvi C. Lall; Michael F. Oglo

[57] ABSTRACT

Aluminum articles are provided with enhanced surface protection by initially abrading the surface to produce a surface microroughness of 400-700 microinches (RMS), and hard anodizing the roughened surface to a depth of at least 0.0020 inch. The anodized surface is then coated with a protective material to a thickness of 0.0005-0.015 inch. The protective coating materials may be fusible polymers which are fused on the surface or fluid organic coating compositions which are dried on the surface.

10 Claims, No Drawings

PROTECTIVE COATING SYSTEM FOR ALUMINUM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

(1) Field of the Invention

The present invention relates to methods for producing protective coatings upon aluminum articles.

As is well known, aluminum and aluminum alloys are readily fabricated for many applications and are favored for a number of applications because they are light weight and exhibit other desirable physical properties. Moreover, special aluminum alloys offering a high degree of resistance to marine or other environments have been developed for special applications. Nevertheless, aluminum alloys are susceptible to varying degrees of environmental attack at their exposed surfaces. Because aluminum does exhibit relatively low hardness as compared with ferrous alloys, the surface of the articles may be scarred during transport or during usage. This becomes a more acute problem when the articles are intended to be used repeatedly.

As is well known, surface scars can increase the tendency for corrosion and a variety of procedures to improve the resistance of aluminum articles to surface marring have been used. Frequently, such surfaces are anodized and this also has the effect of improving the resistance to attack in a particular environment. In other instances, the aluminum articles are coated with organic coating materials which will provide an element of sacrificial protection for the surface, and such organic coatings may be superior in corrosion resistance to anodizing in a number of hostile environments.

Unfortunately, the bond between organic coating materials and the aluminum substrate is not always strong enough to resist impacts and other physical attacks upon the surface. Once the coating has been ruptured at any point, the underlying aluminum surface is subject to attack by the hostile environment and the adjacent coating may be lifted as a result. Chemical treatments of various types have been proposed in an effort to increase the bonding strength of the organic coating to the aluminum substrate, but generally these have not proven so effective as is desirable.

It is an object of the present invention to provide a novel method for providing a highly adherent and resistant protective coating on aluminum articles.

It is also an object to provide such a method for providing such protective coatings on aluminum articles, which method is relatively simple and adaptable to various configurations articles.

Another object is to provide such a method which may be varied depending upon the articles being treated and the environment to which they are to be exposed.

SUMMARY OF THE INVENTION

It has now been found that the foregoing and related objects may be readily attained in a method for developing a protective coating on aluminum articles which includes initially abrading its surface to produce a surface microroughness of 250–1250 microinches (RMS), and thereafter hard anodizing the roughened surface to a depth of at least 0.0015 inch. The anodized surface is then coated with a protective material to a thickness of 0.0015–0.015 inch.

Preferably, the abrading step comprises grit blasting with aluminum oxide particles. Usually, the anodizing step comprises immersing the article in a sulfuric acid bath and exposing it to an electrolytic current. Thereafter, the anodized surface may be sealed in a dichromate solution.

The preferred techniques involve the application of thermoplastic and thermosetting polymer particles to the anodized surface, and causing fusion or cure of the particles to thereby produce a continuous coating. The articles may be preheated to effect such fusion, or the article may be exposed to heating after application of the polymer particles to fuse the particles and produce a continuous coating.

Most desirably, the microroughness is within the range of 400–700 microinches, and the anodized depth is 0.002–0.004 inch. Alternatively, a liquid organic coating material may be applied to the anodized surface and the coating material thereafter dried. Another technique is one in which a ceramic material is sprayed onto the anodized surface, and the ceramic coating is thereafter sealed.

DESCRIPTION OF THE PREFERRED EMBODIMENT

As previously indicated, it has been found that a highly effective protective coating can be developed by a method in which the clean aluminum surface is subjected to an abrasive action to produce surface microroughness and thereafter hard anodized. The anodized surface is then provided with a coating of a protective material which is firmly bonded to the microroughened substrate.

The surface of the articles to be treated should be clean and free from grease or other lubricants, paints, and other contaminants. Even an apparently clean surface may be desirably subjected to a degreasing treatment, rinsed and dried.

Turning first to the abrading step, various techniques may be employed, but grit blasting with aluminum oxide particles has been found to be highly advantageous and relatively economical.

The preferred abrasive media are aluminum oxide particles since any such particles which might remain embedded in the surface of the article will have minimal corrosive effect with respect thereto. Silica particles may also be employed for the same reason. However, other abrasive particles such as ferric and other metallic oxides and carbides may also be employed if any embedded particles can be eliminated by a post treatment step.

The size of the abrasive particles employed will generally be within the range of 35 to 16 mesh grit size, and preferably about 28–20 grit.

The pressures employed will normally be within the range of 60–100 p.s.i. and preferably about 80 p.s.i. The time period for the grit blasting will normally depend upon the grit particles, the pressures employed, and the flow rate. To achieve optimum results, the nozzle should be close to the surface and distances of 1–2 inches have been satisfactory.

The profile of the abraded surface should show a surface microroughness of 250–1250 microinches (RMS) and preferably 400–700 microinches. A surface finish of 400–700 microinches represents a rougher finish than the "white-metal" profile which is commonly specified in connection with processes to fully clean a substrate surface, and in other respects represents the roughest practical profile that can be attained repeatedly using economical techniques.

Because the abraded surface is relatively soft, the measurement of the roughness is more easily performed on the anodized surface. Measurements in the soft surface (i.e., "soft" by comparison to the same surface later anodized) are often not representative of actual roughness due to limitations in economical measurement techniques. The common (and economical technique) for roughness measurement employs a diamond tipped stylus profilometer, which in fact destroys the peaks and depressions ("hills and valleys") of the rough surface. Stated another way, the weight of the hard stylus dragging across the surface can change the surface, and will typically cause smoother readings. It has been observed that when a soft surface having an apparent surface roughness in the range of 250–1250 microinches (RMS), i.e., measured employing diamond tipped stylus apparatus and therefore involving the above-described smoothing of readings, is hard anodized to a depth of at least 0.0015 inch, the anodized surface will retain a roughness of 300–1250 microinches (RMS).

Following the abrading step, the articles are subjected to a hard anodizing step which will generally comprise immersing the articles in a sulfuric acid bath and then applying an electric potential across the article to develop an anodized coating of at least 0.0015 inch in thickness and preferably at least 0.0020 inch in thickness. The anodized coating may be as thick as 0.0045 inch. Little additional benefit is gained from thicknesses in excess of 0.0030.

Following the anodizing step, it may be desirable to seal the anodized surface by treating it with a solution of alkali metal dichromate, nickel acetate, deionized water, or other known sealing agents, or combinations of agents for anodized surfaces. If the entire surface of the article is to be provided with the coating material, then such sealing is not necessary and it may even adversely affect the properties of the ultimate coating. However, anodizing will provide protection for surface areas which are not to be provided with the protective top coating. Generally, a hot solution containing 15% by weight of sodium dichromate is effective for such sealing action, and immersion or other exposure to the solution for periods of 1–5 minutes will provide the sealing action.

A number of protective coating materials may be utilized in the last step of the process of the present invention, including powdered synthetic resins which are fused or cured on the anodized surface, liquid organic coating materials, and ceramic coating materials.

For ease of application and optimum properties commensurate with reasonable cost, powdered synthetic resin materials are preferred for the process of the present invention. Such synthetic resin materials may comprise thermoplastics which are melted upon the surface of the articles to produce a continuous layer over the anodized surface, or they may comprise partially cured materials such as B-stage epoxy resins which are finally cured into a continuous coating upon the surface of the heated article. The powdered polymer is preferably sprayed onto the preheated surface of the article, and electrostatic spray techniques are preferable where they fuse on cure. Alternatively, particles may be electrostatically coated upon the surface of the article, and then the article subjected to heating in an oven, or by infrared lamps or other suitable techniques. Fluidized beds may also be used to coat the heated articles. Generally, the temperatures required for fusion of the particles or further curing of B-stage resins will be within the range of 250 degrees to 450 degrees F and preferably, on the order of 275 degrees to 375 degrees F.

Among the resins which may be employed are thermoplastic materials such as polyvinyl chloride, polyolefins, thermoplastic polyamides, thermoplastic polyurethanes, and polyesters. Among the partially cured resins which may be utilized are B-stage epoxy resins and other partially cured thermosetting resins which will cure to a continuous surface coating when applied to the substrate. For most applications, the partially cured epoxides have been found highly satisfactory because of their relatively low cost and good abrasion resistant properties when fully cured.

Liquid coating materials such as solutions, suspensions or emulsions of resins may also be employed as can be two-component polymer systems which will cure when applied to the surface. Generally, these materials may be sprayed, brushed or roller coated onto the surface. Where appropriate, immersion techniques may also be employed. After coating, the articles are either heated or allowed to air dry to produce the desired continuous surface coating.

In addition to the organic coating materials which have therefore been described, it has been found that ceramic coatings afford a high degree of surface protection, albeit at substantially greater cost. Generally, such ceramic coating involves plasma spraying aluminum oxide onto the surface to the desired thickness, and then a liquid sealer is applied to seal the porous ceramic coating which is thus developed.

Whatever the coating material employed for the top layer, its thickness should be within the range of 0.0015–0.015 inch and preferably 0.005–0.010 inch. However, greater thicknesses may also be employed, albeit with little additional benefit.

If so desired when liquid coating materials are being employed, a thin layer of primer may be initially applied to the anodized surface in order to increase the bond between the anodized surface and the ultimate coating material. Any such primer selected should be compatible with the coating material which is to be applied thereto and demonstrate good adhesion to the anodized aluminum surface.

EXEMPLARY EMBODIMENT - COMPARATIVE RESULTS

Following are: (i) an exemplary embodiment of the process of the present invention, and (ii) a contrasting exemplary embodiment of a different process characterized by omission of the step of initially abrading the surface of the aluminum article. Test results comparing the relative resistance to damage of these two articles is then presented.

Two longitudinally adjacent shell sections of a torpedo were cleaned and degreased. One of these shell sections was thereafter grit blasted with aluminum oxide grit having a grit size of 24 at a blast pressure of 80 p.s.i. at a nozzle distance of 1–2 inches. The surface finish from the grit blasting operation was found to be within the range of 400–700 microinches (RMS). The tank section was masked in areas where the aluminum was not to be coated.

Following the grit blasting, the tank section was them immersed in sulphuric acid and exposed to an electric current providing a current density of 45 amperes per square foot for a period sufficient to develop an anodized coating having a thickness of 0.0025 inch. Following the anodizing step, the anodized coating was sealed by immersion in a 15% solution of sodium dichromate for approximately five (5) minutes. The surface of the article was then rinsed and dried.

The tank section was then preheated to 300 degrees F. and a powdered epoxy B-stage resin sold by Ferro Corporation under the designation Vedoc VE-309 was electrostatically sprayed onto the surface to develop an uniform epoxy coating on the exposed surface having a thickness of 0.0047 inch. This coating was then cured for 15 minutes at 300 degrees F.

The second of the two longitudinally adjacent shell sections was anodized and provided with a coating in substantially the same manner, but it was not subjected to the initial step of producing a microroughened surface by grit blasting.

A torpedo employing both tank sections was subjected to normal usage involving three runs in salt water for extended distances, and the normal handling attendant thereto. Normal handling includes loading, handling, launch and sea recovery. The exterior surface of the shell section produced in accordance with the method of the present invention was found to have only 0.3 sq. in. of its surface area damaged to an extent requiring repair, as compared to 450 sq. in. for the shell section which had not been provided with the microroughened surface.

Thus, it can be seen from the foregoing detailed specification and specific example that the method of the present. invention provides a highly desirable protective coating upon the surface of aluminum articles. The coating exhibits excellent adhesion to the aluminum substrate, and good resistance to abrasion and impact. The coating may be developed relatively economically on articles of various contours.

Obviously many modifications and variations of the present invention may become apparent in light of the above teachings. For example, the desired surface roughness of an aluminum article could be produced by a method other than abrading, such as in the course of a casting process or by means of a chemical etching process.

In light of the above, it is therefore understood that within the scope of the appended claims, the invention may be practiced otherwise than as specifically described.

What is claimed is:

1. In a method for providing a protective coating on aluminum articles, the steps comprising:

(a) abrading the surface of an aluminum article to produce a surface microroughness of 400–700 microinches (RMS);

(b) hard anodizing the roughened surface to a depth of 0.0020–0.0045 inch to provide a surface with a retained surface microroughness of at least 300 microinches (RMS); and (c) coating the anodized surface with a protective material to a thickness of 0.0015–0.015 inch.

2. The coating method in accordance with claim 1 wherein said abrading step comprises grit blasting with aluminum oxide particles.

3. The coating method in accordance with claim 1 wherein said anodizing step comprises immersing said article in a sulfuric acid bath and exposing it to an electric current, and thereafter sealing the anodized surface in a dichromate solution.

4. The coating method in accordance with claim 1 wherein said coating step comprises heating said article and depositing particles of a polymer upon said anodized surface, the particles upon being so deposited fusing to produce said coating.

5. The coating method in accordance with claim 1 wherein particles of polymer are deposited upon said anodized surface and said surface is heated to a temperature and for a time sufficient to fuse said particles and produce a continuous coating.

6. The coating method in accordance with claim 1 wherein said coating step comprises applying a liquid organic coating material on said anodized surface and drying said coating material.

7. The coating method in accordance with claim 1 wherein said coating step comprises plasma spraying a ceramic material onto said anodized surface, and sealing said ceramic coating.

8. In a method for producing a protective coating on aluminum articles, the steps comprising:

(a) roughening the surface of an aluminum article by abrasion with aluminum oxide particles to produce a surface microroughness of 400–700 microinches (RMS);

(b) hard anodizing the roughened surface to a depth of 0.0020–0.0045 inch by immersing said article in an electrolytic bath and exposing it to an electric current, said anodized surface retaining a microroughness of at least 300 microinches (RMS); and (c) coating the anodized surface with a protective polymeric material by depositing particles of a polymer thereon and fusing said particles to produce a coating having a thickness of 0.0015–0.015 inch.

9. The coating method in accordance with claim 8 wherein said coating step comprises heating said article and depositing particles of a polymer upon said anodized surface, the particles upon being so deposited fusing to produce said coating.

10. The coating method in accordance with claim 8 wherein particles of thermoplastic polymer are deposited upon said anodized surface and said surface is heated to a temperature and for a time sufficient to fuse said particles and produce a continuous coating.

* * * * *

UNITED STATES PATENT AND TRADEMARK OFFICE

CERTIFICATE OF CORRECTION

PATENT NO. : 5,104,514

DATED : Apr. 14, 1992

INVENTOR(S) : JAMES M. QUARTARONE

It is certified that error appears in the above-identified patent and that said Letters Patent is hereby corrected as shown below:

Title page,Item [75], change "M." to --R.--.

Signed and Sealed this

Twenty-second Day of June, 1993

*Attest:*

Michael K. Kirk

MICHAEL K. KIRK

*Attesting Officer*

*Acting Commissioner of Patents and Trademarks*